United States Patent [19]

Wilkinson

[11] Patent Number: 4,514,779

[45] Date of Patent: Apr. 30, 1985

[54] METHODS AND APPARATUS FOR NEUTRALIZING A STATIC ELECTRICAL CHARGE ON POWDER PARTICLES

[75] Inventor: John S. Wilkinson, Venice, Fla.

[73] Assignee: Therm-O-Type Corporation, Nokomis, Fla.

[21] Appl. No.: 502,549

[22] Filed: Jun. 9, 1983

[51] Int. Cl.[3] ..... H05F 3/00

[52] U.S. Cl. ..... 361/213; 118/312; 118/602; 427/197; 427/345

[58] Field of Search ..... 361/213, 212, 226; 427/197, 345; 118/312, 602

[56] References Cited

U.S. PATENT DOCUMENTS

| | | | |
|---|---|---|---|
| 1,977,991 | 10/1934 | Hawkins | 361/212 X |
| 2,757,635 | 8/1956 | Lipsius | 118/312 |
| 3,308,344 | 3/1967 | Smith et al. | 361/213 X |
| 4,048,667 | 9/1977 | Brennecke | 361/213 |
| 4,414,913 | 11/1983 | Sarda | 118/312 X |

*Primary Examiner*—Reinhard J. Eisenzopf

*Attorney, Agent, or Firm*—Burns, Doane, Swecker & Mathis

[57] ABSTRACT

A thermography machine applies thermography powder to the printed surfaces of sheets. Excess powder is vacuumed from the sheets under the influence of suction generated by a cyclone separator which separates the excess powder from an air stream in which the powder is entrained. A static charge eliminator is provided for neutralizing the electrical charge on the powder particles to facilitate a smooth flow of the particles through the separator. The static charge eliminator includes a plurality of electrical charged pins across which is conducted a flow of outside air which is sucked through the static charge eliminator by the suction pressure from the separator. As the air flows across the charged pins, oxygen is converted to ozone and the ozone is conducted into contact with the powder particles within the separator. The pins have a contoured profile along their length to maximize the ozone-producing process.

17 Claims, 6 Drawing Figures

FIG. 3
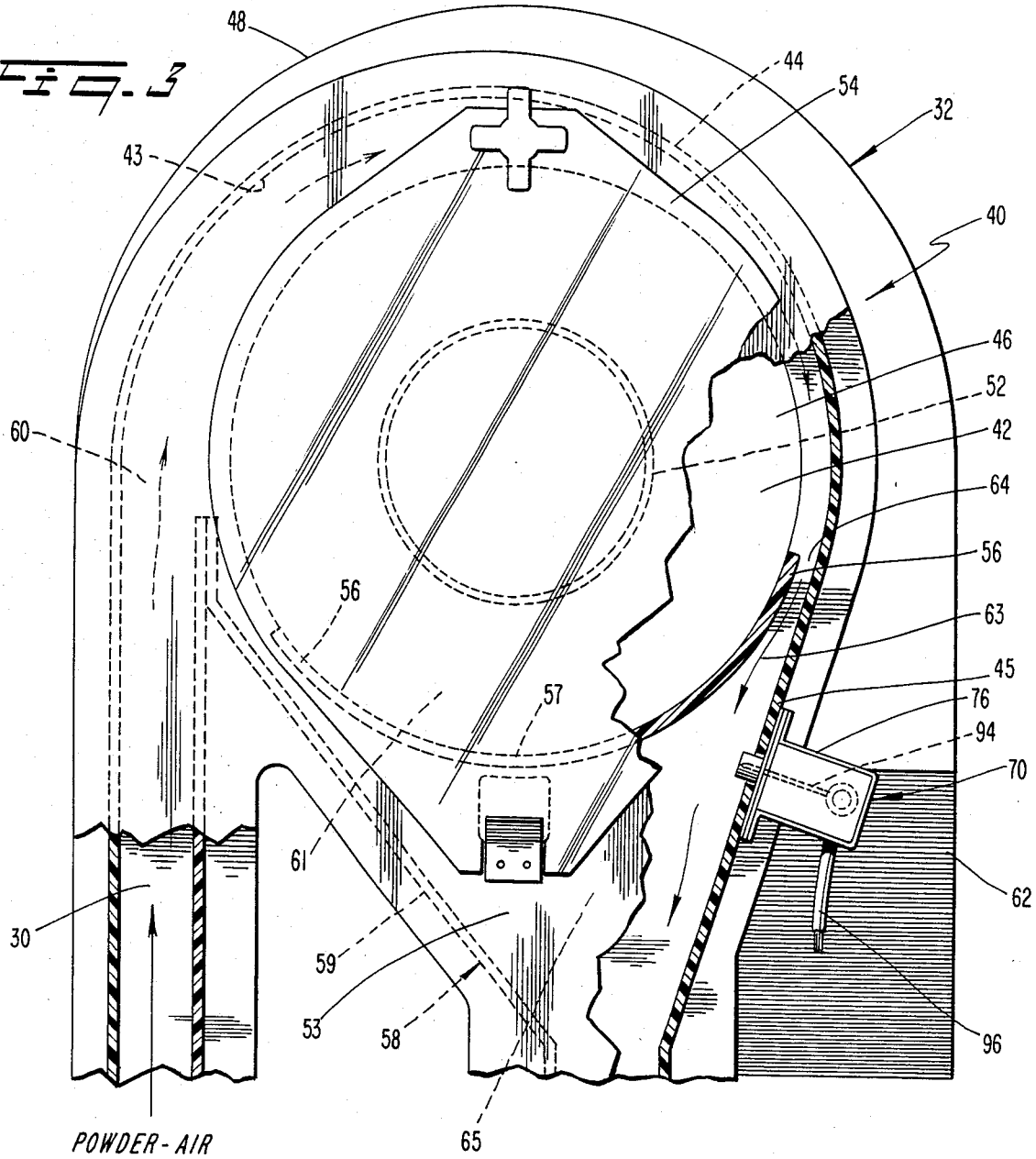
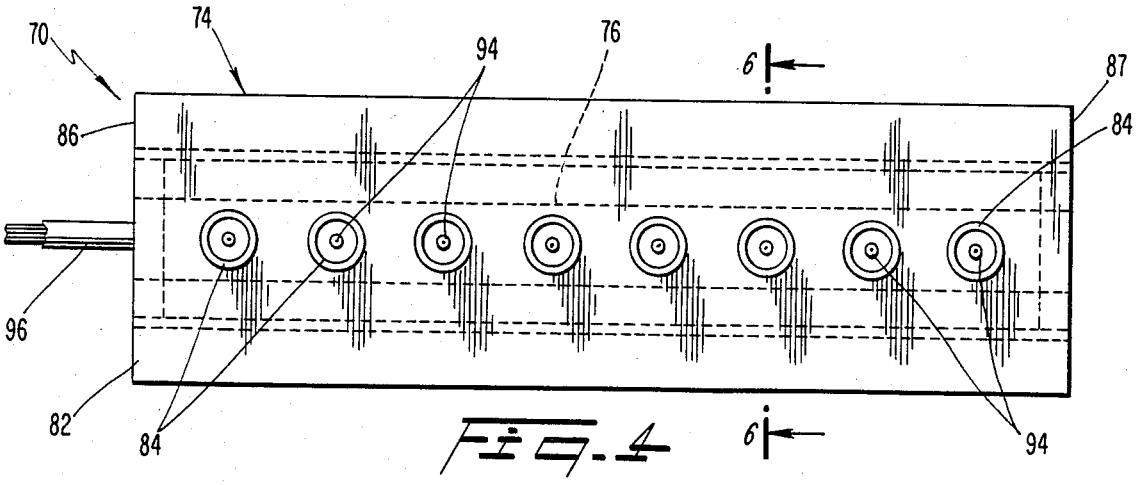
FIG. 4

METHODS AND APPARATUS FOR NEUTRALIZING A STATIC ELECTRICAL CHARGE ON POWDER PARTICLES

BACKGROUND AND OBJECTS OF THE INVENTION

Broadly, the present invention relates to the separation of powder particles from an air stream in which the particles are entrained. More particularly, the present invention relates to thermography and especially to the elimination or reduction of static electricity in a centrifugal separator for thermography powder.

Thermography, or raised printing, is carried out by applying a thermography powder, such as a resin-based powder, onto a printed sheet while the ink thereon is still tacky. Sufficient heat is applied to melt the powder, whereupon the powder expands and thus imparts a "raised" effect to the printed areas.

One type of thermography apparatus which has heretofore been employed for carrying-out raised printing operations has included a powder-applying section through which the printed paper sheets are fed. In this section, resinous powder, e.g., a nylon resin, is applied from a hopper onto the printed surface of each sheet and adheres to the still-tacky ink. Thereafter, excess powder is sucked from the sheet by a vacuum pick-up head, leaving powder only on the ink. The sheets are then conveyed through a heat tunnel in which the sheets and powder are heated to the melting temperature of the powder. As the powder melts, it expands and thus "raises" the printing. Thereafter, the sheets are conveyed through a cooling tunnel wherein the raised print is solidified.

In the above-described powder-applying section, the excess powder is sucked from the sheets by means of negative pressure generated by a powder/air separator which then separates the powder particles from the air stream in which they are entrained. The separator operates under conventional centrifugal/cyclone principles wherein the powder/air stream enters a separation chamber in a tangential direction such that centrifugal force impels the powder particles outwardly toward a curved wall of the chamber as the particles travel along the wall toward an exit leading to a discharge valve. The air stream swirls through a center opening in the chamber in cyclone fashion by means of a negative pressure produced by a suction fan. The discharge valve operates to intermittently disperse powder back to the powder distributing hopper.

On occasion, the proper discharge of powder from the separator is hampered by powder particles charged with static electricity. In that regard, the powder particles may pick-up a static charge during travel from the pick-up head and/or through the separation chamber, which results in the particles becoming suspended above the discharge valve. That is, the charged particles are compelled to swirl-about above the valve, rather than gravitating thereto. Hence, the hopper is not replenished at a sufficiently rapid rate.

It is known that particles which possess a static charge can be neutralized by being contacted with gaseous ozone. Ozone is easily formed since it is the by-product of an electrical discharge or spark occurring in air. Ozonators operating under that principal are available commercially. One such ozonator comprises a series of metal pins which project radially from a metal tube. The tube is electrically charged so that the electrical discharges from the pins produce ozone. The placement of such an ozonator within the separation chamber of the above-described powder/air separator of a thermographic printer was tested. However, this failed to produce satisfactory results, mainly because the powder particles were not neutralized at a sufficiently rapid rate. That is, the quantity of powder particles neutralized per unit time was too low.

It is, therefore, an object of the present invention to minimize or obviate problems of the sort discussed above.

Another object is to provide methods and apparatus for neutralizing charged powder particles in a powder-/air separator, especially of the type for feeding thermography powder.

An additional object is to neutralize the static charge of powder particles in a cyclone separator in a manner which eliminates a tendency for the particles to swirl-about above the powder discharge.

A further object is to assure that a large quantity of statically charged powder particles are contacted by ozone rapidly enough to prevent any appreciable decline in the powder discharge rate of a powder/air separator.

SUMMARY OF THE INVENTION

These objects are achieved by the present invention which relates to the separation of powder particles from an air stream in which the powder particles are entrained. Preferably, a powder/air separator is employed in combination with a thermography machine to suck excess powder which has been deposited onto printed sheets.

The separator comprises a casing forming a separation chamber having a powder/air inlet and a powder outlet. The casing includes a back wall and a side wall extending outwardly from the back wall. The side wall includes a curved portion which extends from the powder/air inlet and merges with a straight portion of the side wall, the latter extending toward the powder outlet. An air inlet is formed in the back wall. A suction mechanism creates suction pressure through the air outlet to evacuate the separation chamber. A curved deflector wall is disposed opposite the curved portion of the side wall to form therewith a generally annular space around the air outlet in which the air swirls before passing through the air outlet. The powder/air inlet is arranged to introduce a powder/air stream tangentially into the separation chamber under the influence of the suction created therein by the suction mechanism, such that the powder particles are centrifugally urged toward the side wall during travel therealong toward the powder outlet. A static charge eliminator is provided for neutralizing the electrical charge of the powder particles before the particles reach the powder outlet. The static eliminator comprises an electrically chargeable part and an air conducting housing extending around the electrically chargeable part. The air conducting housing has a gas exit communicating with the separation chamber and a gas entrance communicating with air located outside of the separation chamber. The air conducting housing is arranged to conduct a flow of air across the electrical chargeable part from the gas inlet under the influence of suction from the separation chamber. Ozone gas is formed as a reaction product during passage of such air across the electrical chargeable part. The gas exit is arranged to introduce the ozone gas into the separation chamber along a portion of the side wall such that the ozone gas contacts and neutralizes the powder particles traveling therepast.

The present invention is also directed to the static eliminator itself, and to a method for neutralizing the electrical charge on powder particles.

THE DRAWING

The objects and advantages of the invention will become apparent from the following detailed description of a preferred embodiment thereof, in connection with the accompanying drawings in which like numerals designate like elements and in which:

FIG. 3 is a front elevational view, with parts broken away, of the powder/air separator and depicting the static charge eliminator in side elevation;

FIG. 4 is a front elevational view of the static charge eliminator;

DETAILED DESCRIPTION OF A PREFERRED EMBODIMENT OF THE INVENTION

Figure 1:
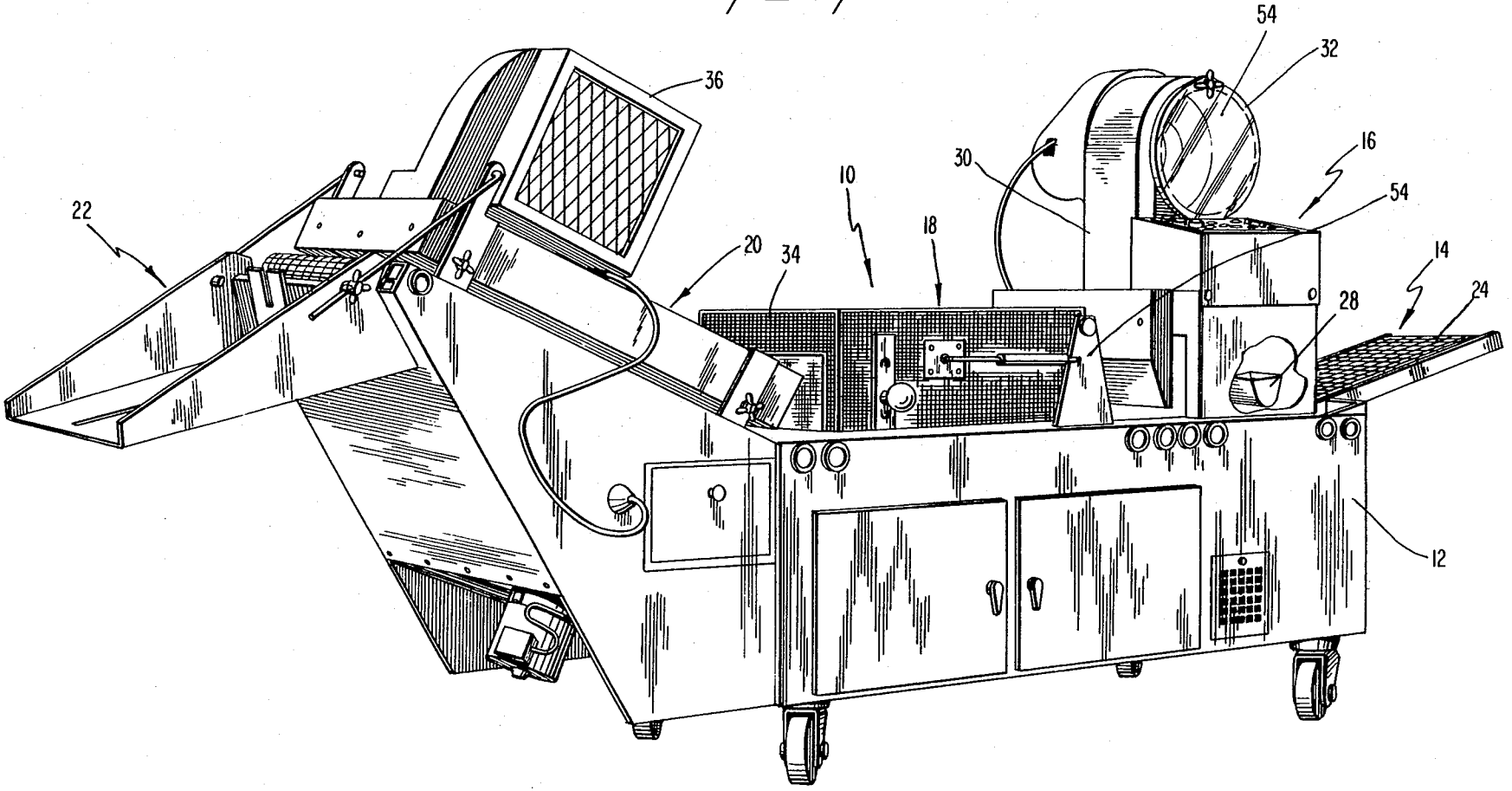
FIG. 1 is a perspective view of a thermography machine which utilizes a powder/air separator according to the present invention.

A thermography machine 10 according to the present invention comprises a frame 12 which supports a sheet infeed section 14, a powder applying section 16, a heating section 18, a cooling section 20, and a discharge section 22.

The paper infeed section is conventional and includes one or more driven belts 25 for feeding sheets one-at-a-time to a second belt (not shown), the latter feeding the sheets through the powder applying section 16. The powder applying section 16 includes a conventional hopper 28 which is situated above the second belt and applies a thermography powder, e.g., a nylon resin based powder, onto the upwardly facing ink-printed surface of each sheet. The powder is applied while the ink is still in a tacky state so that the powder adheres to the ink.

Excess powder is thereafter sucked from the sheet and belt by a conventional vacuum pick-up unit (not shown) which is situated above the second belt at a location downstream of the hopper. The powder travels from the pick-up unit to a conventional powder/air separator 32 via duct 30.

After receiving the powder, the sheets are passed onto a heat-resistant third conveyor belt (not shown) such as an endless stainless steel conveyor belt which conveys the sheets through a heating tunnel 34 of the heating section 18. The heater tunnel contains an electric resistance heater such as a standard Vycor glass, multi-section, infra-red electric heater which heats the powder and sheets passing therebeneath. As the heated powder melts, it expands, thereby producing the "raised effect". Further details of the heater tunnel may be found in copending application Ser. No. 06/433,701 filed Oct. 12, 1982, by the present inventor, the disclosure of which is incorporated by reference herein.

After leaving the heater tunnel 34, the sheets are passed through the cooling section 20 wherein cooling air is blown by a fan 36 onto the sheets to harden the ink. Eventually, the sheets are discharged via the discharge section 22.

Figure 2:
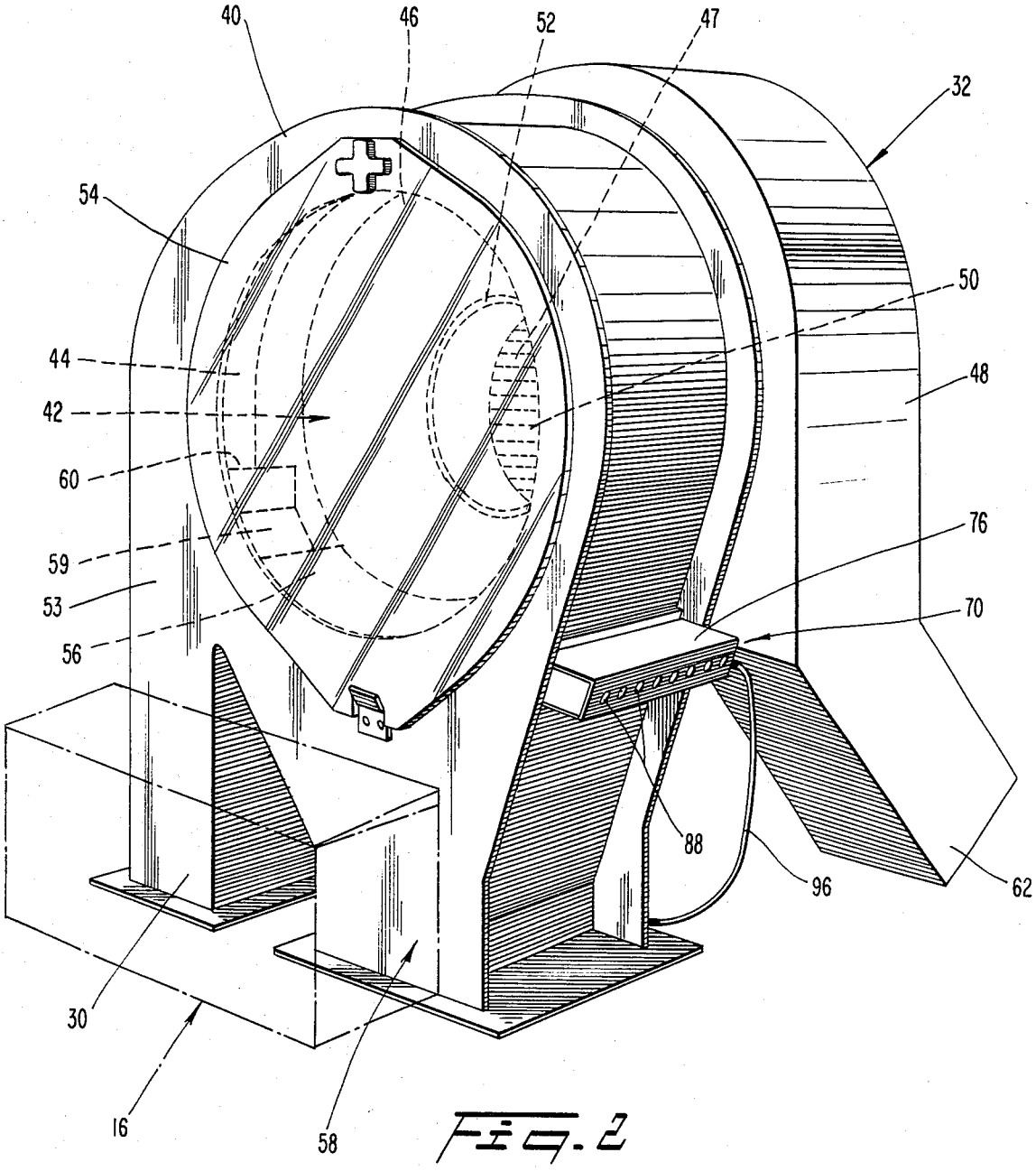
FIG. 2 is a perspective view, from the front, of a separator which utilizes a static charge eliminator according to the present invention.
Figure 5:
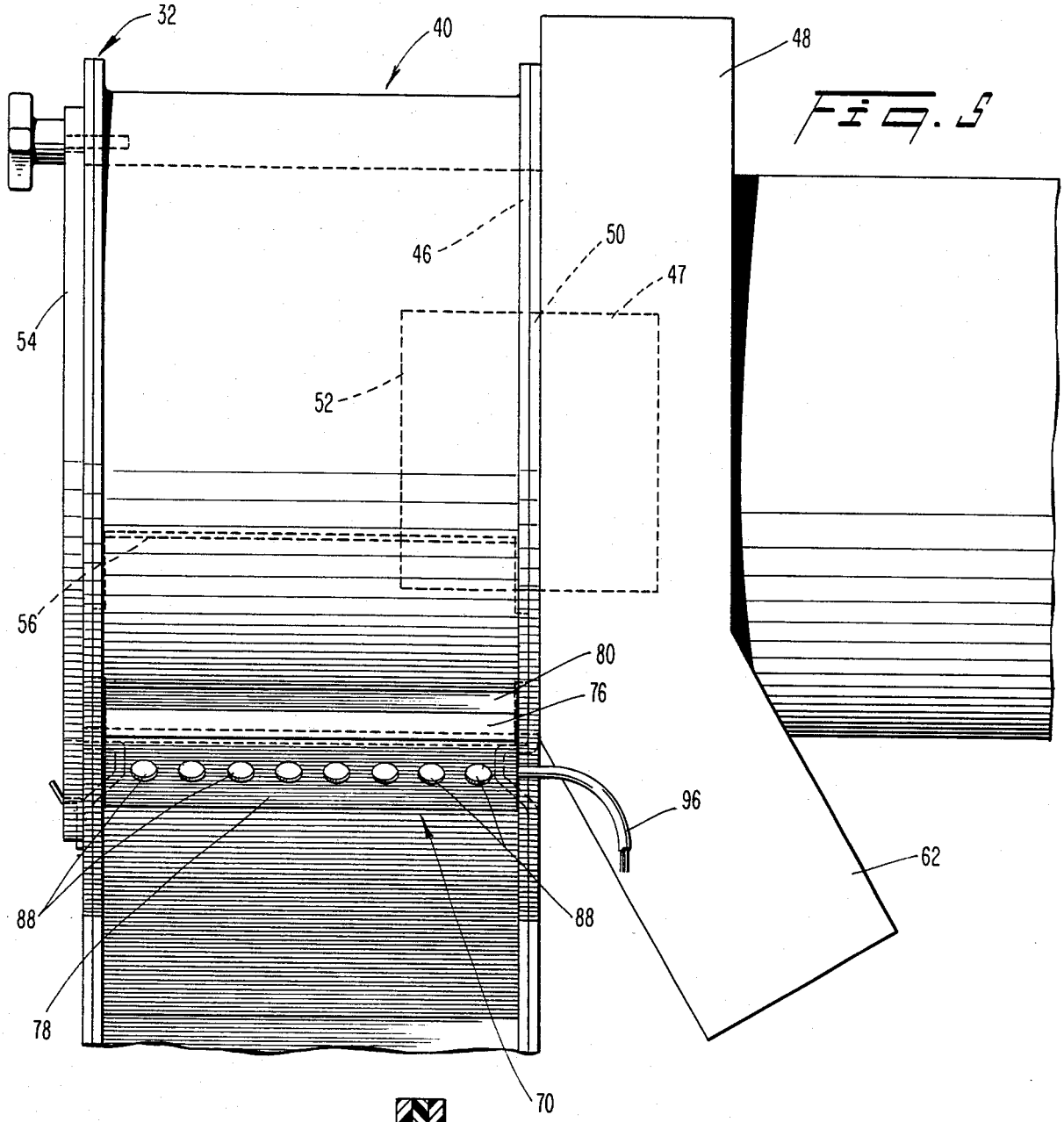
FIG. 5 is a side elevational view of the separator, depicting the static charge eliminator from the rear.

The above-mentioned powder/air separator 32 comprises a conventional cyclone separator which operates under well known centrifugal/cyclone principles. The separator comprises a casing 40 (FIGS. 2, 3, 5) which forms a separation chamber 42 having a side wall 44 and a back wall 46. The side wall includes a curved portion 43 which merges into a straight portion 45 near a discharge section of the separator. On the opposite side of the back wall a rotary suction rotor 47 (FIG. 2) is mounted in an air outlet casing 48, which communicates with the separation chamber 42 by means of an annular passage 50 in the back wall 46.

An annular shroud 52 extends around the annular passage and projects into the separation chamber from the back wall. The rotor 47 is of the squirrel cage variety and rotates about a horizontal axis coinciding with the longitudinal axis of the passage 50. The separator includes a front wall 53 on which is mounted a removal front door 54 which may be formed of a transparent material. Extending between the front and back walls 53, 46 is a curved tray or air deflector plate 56 which is disposed below the passage 50 and above a funnel-shaped powder discharge portion 58 of the casing 40. The straight portion 45 of the side wall, together with another straight wall 59, form the funnel-shaped discharge portion 58.

The plate 56 includes a curved deflector face 57 which is located opposite the curved portion 43 of the side wall 44 to form therewith a central annular space 61 in which the air swirls in cyclone fashion before exiting via the air outlet passage 50.

The casing 40 includes a powder/air inlet 60 located at one end of the curved portion 43 of the back wall. The inlet 60 communicates with the powder pick-up unit by means of the duct 61. Thus, the suction rotor 47 generates a suction within the separation chamber, which suction communicates with the pick-up unit to suck excess powder from the printed sides of the sheets.

The inlet 60 is oriented tangentially to the separation chamber 42 such that the incoming powder/air stream travels along the curved side wall 44. The centrifugal forces acting upon the powder particles as the particles traverse the curved portion 43 of the side wall 44 impel the particles radially outwardly against the curved side wall portion 43. The incoming air whirls in cyclone fashion above the deflector plate 56 before traveling through the passage 50 and the rotor 47 and exiting the casing 48 through an air discharge duct 62.

The powder particles continue to travel downwardly in the direction of the arrow 63 through a narrow gap 64 between the deflector plate 56 and the side wall 44 and along the straight portion 45 of the funnel-shaped powder discharge portion 58 for delivery to a powder outlet which includes a conventional discharge valve (not shown). The valve may constitute simply a horizontal, rotating rod with pockets in the periphery, which pockets pick-up the powder and convey same downwardly until the powder gravitates into the hopper. The apparatus as described thusfar is of a conventional nature.

Figure 6:
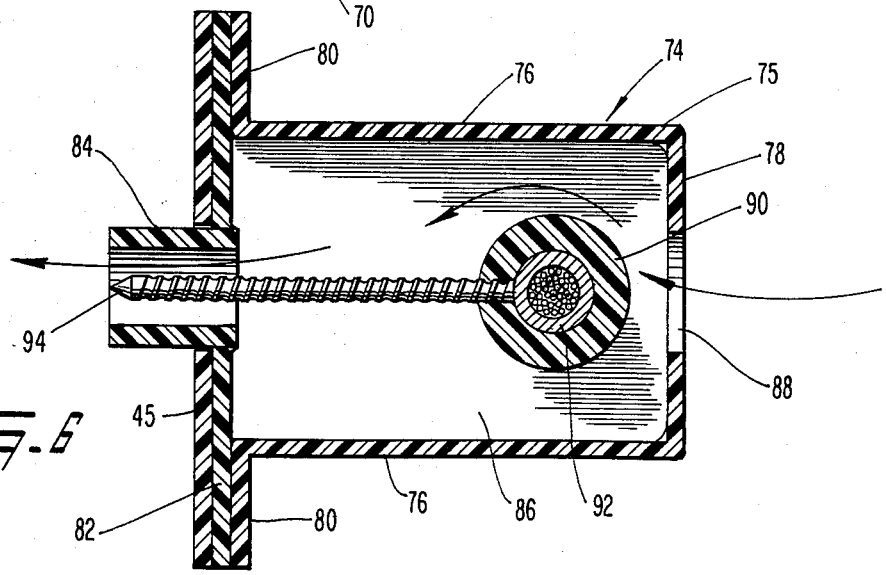
FIG. 6 is a cross-sectional view through the static charge eliminator taken along lines 6—6 of FIG. 4.

As explained earlier, the powder particles may tend to pick-up a static electrical charge while being transported from the pick-up unit to the valve via the separation chamber. The thus-charged powder particles, rather than traveling to the valve, tend to hover in an agitated state in a region 65 of the funnel-shaped portion 58 located beneath the air deflector plate 56. In order to "neutralize" the powder particles and thereby eliminate this problem, a static charge eliminator or anti-static unit 70 is provided in accordance with the present invention. The anti-static unit 70 comprises an electrically chargeable portion 72 enveloped by an air-conducting housing 74. The housing 74 comprises a generally U-shaped member 75 having a pair of parallel legs 76 and a back wall 78 interconnecting adjacent rear ends of the legs 76 (FIG. 6). A pair of flanges 80 project laterally outwardly from the front ends of the legs. Disposed across the front ends of the legs is a front plate 82 which contains a plurality of forwardly projecting hollow tubes 84. A pair of side walls 86, 87 close-off opposite ends of the U-shaped member.

The U-shaped member 75, front plate 80, tubes 84, and side walls 86, 87 are preferably formed of an electrically insulative material, such as plastic for example.

Air inlet openings 88 are provided in the rear wall. The inlet openings may be of any suitable quantity and shape, although a plurality of openings are depicted which correspond in quantity and generally in diameter to the tubes 84, and are aligned therewith.

The electrically emersible portion 72 comprises a hollow cylindrical bar 90, the ends of which are affixed to the side walls 86, 87. The bar 90 is formed of an electrically insulative material such as plastic. An electrically conductive hollow rod 92, formed of non-magnetic stainless steel for example, is positioned within the bar 90. A plurality of pins 94, formed of electrically conductive metal material, project radially from the rod 92 (with reference to the longitudinal axis of the rod) and extend through the bar 90. The pins 94 are arranged in parallel and inner ends thereof are in electrically conductive contact with the rod 92. The outer ends of the pins are disposed within respective tubes 84 of the housing, and preferably, the terminal tips of the pins lie flush with the outer ends of the tubes 84.

The rod 92 is electrically charged by an electric wire 96 which extends through an opening in one of the side walls 86, the electrical charge being conducted to the pins. The pins are spaced apart from one another sufficiently to prevent sparking. That is, the pins do not conduct electrical current, but rather are charged sufficiently to emit a corona-type discharge which reacts with surrounding air to convert oxygen to ozone. A voltage of 7000 volts has been found suitable in one instance to provide the desired charging of the pins.

The pins 94 are preferably contoured in profile to define raised and recessed portions alternating in the direction of the longitudinal axis of the pin. So-called "panel nails" which are commercially available can be used for this purpose.

The anti-static device 70 is mounted to the separator 40 by drilling into the straight portion 45 of the side wall 44 a plurality of holes corresponding in quantity and diameter to the tubes 84 of the housing 74. The tubes 84 are inserted through respective ones of the holes and the front plate 82 is suitably affixed to the outer surface of the straight portion 45 by means of glue or fasteners for example.

The holes are preferably located such that the tubes are positioned upstream of the powder outlet (with reference to the direction of flow of the powder) and most preferably within the funnel-shaped portion 58 and just below the restricted gap 64 formed between the deflector plate 56 and the side wall 44. Optimum results are achieved if the tubes are also positioned above the afore-described region 65 where the charged powder particles would tend to hover in the absence of a static charge neutralizer. In practice, by locating the tubes 84 close to the gap 64, a considerable amount of neutralizing air flow through the tubes 84 is generated as will become apparent from the following description.

In operation of the separator 40, the vacuum generated by the rotor 47 tends to suck excess powder from the printed sheets. The powder/air flow travels through the duct 30 and into the separation chamber 42. The air passes through the central passage 50, but the particles travel in close proximity to the side wall 44 under the influence of centrifugal force and pass downwardly through the gap 64. The suction generated by the rotor 64 also tends to draw outside air into the housing 74 of the anti-static unit 70 through the air inlet openings 88. As this air passes across the electrically energized pins 94, the corona discharge from the pins converts oxygen to gaseous ozone which then passes through the tubes 84 and into the separation chamber 42. That is, the high voltage dielectrically shielded wire 96 passes, with no metallic contact, through the conductive rod 92, while the corona effect of the voltage causes a static build-up. This static build-up transfers to the emission pins, which in the presence of the high velocity air with its natural impurities creates a charge of ozone. The ozone, in turn, searches the flow of powder and releases its emission charge to the powder. This neutralizing effect causes the powder to drop out of the air stream.

The rate of travel of the air across the pins is accelerated due to the reduced cross-sectional area of the tubes 84 (venturi effect) thereby providing a high-rate production of ozone. As the ozone flows upwardly toward and through the gap 64 it contacts the downwardly traveling powder particles in counterflow relationship therewith. This contact results in the ozone neutralizing the statically charged powder particles.

Since the air is induced to flow across the pins at high flow rates, it is assured that an ample supply of neutralizing ozone will be furnished to neutralize the powder particles. Hence, virtually all of the charged powder particles will, in practice, be neutralized.

Importantly, it has been found that the contoured profile of the pins 94 greatly increases the effectiveness of the anti-static unit in comparison to the use of pins which possess smooth cylindrical outer peripheries. This result is due to the increased area of contact between the air and the pins resulting from the contoured profile, and an altering of the flow pattern of the air by the contoured pins. Highly superior results have been observed when non-contoured pins were replaced with contoured pins, with other factors remaining the same.

Although the present invention has been described in connection with a preferred embodiment thereof, it will be appreciated by those skilled in the art that additions, modifications, substitutions, and deletions may be made, without departing from the spirit and scope of the invention as defined by the foregoing appended claims.

What is claimed is:

1. In a powder/air separator for separating powder particles from an air stream in which the powder particles are entrained, said separator comprising:

a casing forming a separation chamber having a powder/air inlet and a powder outlet, said casing including a back wall and a side wall extending outwardly from said back wall, said side wall including a curved portion which extends from said powder/air inlet and merges with a straight portion of said side wall, the latter extending toward said powder outlet, an air outlet formed in said back wall, suction means for creating suction pressure through said air outlet to evacuate said separation chamber, a curved deflector wall disposed opposite said curved portion of said side wall to form therewith a generally annular space around said air outlet in which the air swirls before passing through said air outlet, said powder/air inlet being arranged to introduce a powder/air stream tangentially into said separation chamber under the influence of the suction created therein by said suction means, such that the powder particles are centrifugally urged toward said side wall during travel therealong toward said powder outlet, the improvement comprising:

a static charge eliminator for neutralizing the electrical charge of the powder particles before the particles reach said powder outlet, said static eliminator comprising:

an electrically chargeable means, and air conducting means extending around said electrically chargeable means and having a gas exit communicating with said separation chamber, and a gas entrance communicating with air located outside of said separation chamber, said air conducting means arranged to conduct flow of air across said electrically chargeable means from said gas inlet under the influence of suction from said separation chamber, with ozone gas being formed as a reaction product during passage of such air across said electrically chargeable means, said gas exit being arranged to introduce the ozone gas into said separation chamber along a portion of said side wall such that the ozone gas contacts and neutralizes the powder particles traveling therepast, said delector wall and said side wall forming a gap through which the powder travels toward said powder outlet, said gas exit being arranged to introduce ozone gas into said separation chamber downstream of said gap.

2. A separator according to claim 1, wherein said straight portion of said side wall extends along one side of a funnel-shaped portion of said casing, said gas exit being arranged to introduce ozone gas through said straight portion.

3. A separator according to claim 1, wherein said static charge eliminator comprises a housing mounted on said casing, said housing having a plurality of electrically insulative tubes extending through said side wall of said separation chamber, said electrically chargeable means comprising a plurality of electrically conductive pins disposed within respective ones of said tubes, and means for electrically charging said pins to produce a corona discharge.

4. Apparatus according to claim 1, wherein said electrically chargeable means comprises a plurality of pins each having a contoured profile.

5. Apparatus according to claim 3, wherein said pins each have raised and recessed portions alternating in the direction of the longitudinal axis of said pin.

6. Apparatus according to claim 3, wherein said housing has a rear wall disposed opposite said tubes, said gas entrance being formed in said rear wall.

7. In a thermography machine of the type comprising conveyor means for conducting printed sheets, a powder applicator for applying thermography powder to the printed sides of the sheets as the sheets are fed therepast, and a powder/air separator including a separation chamber having a powder/air inlet communicating with a duct for sucking excess powder from the sheets, a powder outlet communicating with said powder applicator, means for generating a suction within said separation chamber to draw-in excess powder from said pick-up means, the improvement comprising a static charge eliminator for neutralizing the electrical charge of powder particles prior to the egress thereof from said separator, said static charge eliminator comprising a housing having gas outlet means communicating with the interior of said separator at a location upstream of said powder outlet, an electrically chargeable means disposed in said housing between said gas outlet and air entrance means formed in said housing, said air entrance means communicating with ambient air such that suction from said separation chamber draws air into said housing through said air entrance means and passes such air across said electrically chargeable means to produce ozone gas which is drawn into said separation chamber through said gas outlet means to neutralize the powder particles.

8. Apparatus according to claim 7, wherein said electrically chargeable means comprises a plurality of spaced apart pins, and means for electrically charging said pins to produce a corona discharge, said gas outlet means comprises a plurality of tubes encompassing at least the outer ends of respective ones.

9. Apparatus according to claim 8, wherein said pins each have a contoured profile.

10. Apparatus according to claim 8, wherein said pins each have raised and recessed portions alternating in the direction of the longitudinal axis of said pin.

11. Apparatus according to claim 7, wherein said separator is a cyclone separator.

12. A static charge eliminator adapted to be mounted on a powder/air separator for neutralizing a static charge on powder particles within the separator, said static charge eliminator comprising a housing having a gas entrance and a gas exit communicating with one another, electrically chargeable means disposed within said housing between said entrance and exit and including a plurality of spaced-apart electrically chargeable pins formed of electrically conductive material, said pins being arranged such that a gas flow from said entrance to said exit passes across said pins to convert oxygen to ozone, said pins each having a profile comprising longitudinally alternating ridges and recesses.

13. A static charge eliminator according to claim 12, wherein said housing includes a plurality of parallel tubes defining said gas exit, said pins being mutually parallel and projecting into said tubes.

14. A method for neutralizing the electrical charge on powder particles within a cyclone separator which separates powder particles from an air stream in which the particles are entrained, said separator comprising a separation chamber having a powder/air inlet, a powder outlet, and an air outlet, and suction means communicating with said separation chamber through said air outlet to create a suction in said separation chamber for drawing-in powder/air through said powder/air inlet, said method comprising the steps of:

providing a plurality of electrically charged members within an air conducting housing which communicates with ambient air and said separation chamber, producing a flow of ambient air into and through said housing under the influence of suction in said separation chamber, passing said flow of ambient air across said electrically charged members to produce ozone gas, and introducing the ozone gas into said separation chamber upstream of said powder outlet to neutralize the powder particles.

15. In a powder/air separator for separating powder particles from an air stream in which the powder particles are entrained, said separator comprising:

a casing forming a separation chamber having a powder/air inlet and a powder outlet, said casing including a back wall and a side wall extending outwardly from said back wall, said side wall including a curved portion which extends from said powder/air inlet and merges with a straight portion of said side wall, the latter extending toward said powder outlet, an air outlet formed in said back wall, suction means for creating suction pressure through said air outlet to evacuate said separation chamber, a curved deflector wall disposed opposite said curved portion of said side wall to form therewith a generally annular space around said air outlet in which the air swirls before passing through said air outlet, said powder/air inlet being arranged to introduce a powder/air stream tangentially into said separation chamber under the influence of the suction created therein by said suction means, such that the powder particles are centrifugally urged toward said side wall during travel therealong toward said powder outlet, the improvement comprising:

a static charge eliminator for neutralizing the electrical charge of the powder particles before the particles reach said powder outlet, said static eliminator comprising:

an electrically chargeable means, air conducting means extending around said electrically chargeable means and having a gas exit communicating with said separation chamber, and a gas entrance communicating with air located outside of said separation chamber, said air conducting means arranged to conduct flow of air across said electrically chargeable means from said gas inlet under the influence of suction from said separation chamber, with ozone gas being formed as a reaction product during passage of such air across said electrically chargeable means, and a housing mounted on said casing, said housing having a plurality of electrically insulative tubes extending through said side wall of said separation chamber, said electrically chargeable means comprsing a plurality of electrically conductive pins disposed within respective ones of said tubes, and means for electrically charging said pins to produce a corona discharge, said gas exit being arranged to introduce the ozone gas into said separation chamber along a portion of said side wall such that the ozone gas contacts and neutralizes the powder particles traveling therepast.

16. Apparatus according to claim 15, wherein said pins each have raised recessed portions alternating in the direction of the longitudinal axis of said pin.

17. Apparatus according to claim 15, wherein said housing has a rear wall disposed opposite said tubes, said gas entrance being formed in said rear wall.

* * * * *